United States Patent [19]

Heynisch

[11] 4,404,494

[45] Sep. 13, 1983

[54] TRAVELLING WAVE TUBE WITH PERIODIC-PERMANENT MAGNET FOCUSING SYSTEM

[75] Inventor: Hinrich Heynisch, Gräfelfing, Fed. Rep. of Germany

[73] Assignee: Siemens Aktiengesellschaft, Berlin and Munich, Fed. Rep. of Germany

[21] Appl. No.: 253,566

[22] Filed: Apr. 13, 1981

[30] Foreign Application Priority Data

Apr. 21, 1980 [DE] Fed. Rep. of Germany ..... 3015231

[51] Int. Cl.[3] ..... H01J 25/34

[52] U.S. Cl. ..... 315/3.5; 315/5.35; 315/3.6

[58] Field of Search ..... 315/5.34, 5.35, 3.6, 315/3.5, 39.3

[56] References Cited

U.S. PATENT DOCUMENTS

| | | | |
|---|---|---|---|
| 2,843,775 | 7/1958 | Yasuda | 315/3.5 X |
| 2,965,782 | 12/1960 | Weaver | 315/3.5 |
| 3,188,533 | 6/1965 | Bretting et al. | 315/3.5 X |
| 3,401,295 | 9/1968 | Suzuki | 315/3.5 X |

FOREIGN PATENT DOCUMENTS

| | | | |
|---|---|---|---|
| 2119817 | 11/1972 | Fed. Rep. of Germany | 315/5.35 |
| 2556464 | 2/1977 | Fed. Rep. of Germany | 315/5.35 |

*Primary Examiner*—Saxfield Chatmon, Jr.

*Attorney, Agent, or Firm*—Herbert L. Lerner; Laurence A. Greenberg

[57] ABSTRACT

Travelling wave tube, including a cylindrical vacuum shell having an outer diameter, a permanent magnet system surrounding the cylindrical vacuum shell including ring-shaped pole shoes having inner and outer diameters, magnet rings having inner and outer diameters and forming pairs with the pole shoes, each of the magnet rings being alternatingly disposed between two pole shoes in axial direction and being poled in opposite sense with respect to the next magnet ring, the inner diameters of the pole shoes being closely fitted around the vacuum shell and being smaller than the inner diameters of the magnet rings, the outer diameters of the magnet ring being larger than the outer diameters of the pole shoes, and a centering and retaining ring being adjacent to and in contact with each of the pole shoe and magnet ring pairs for centralizing the inner diameters of the pole shoes to the outer diameters of the magnet rings and for centralizing the inner diameters of the pole shoes and the outer diameters of the magnet rings to the outer diameter of the vacuum shell.

6 Claims, 1 Drawing Figure

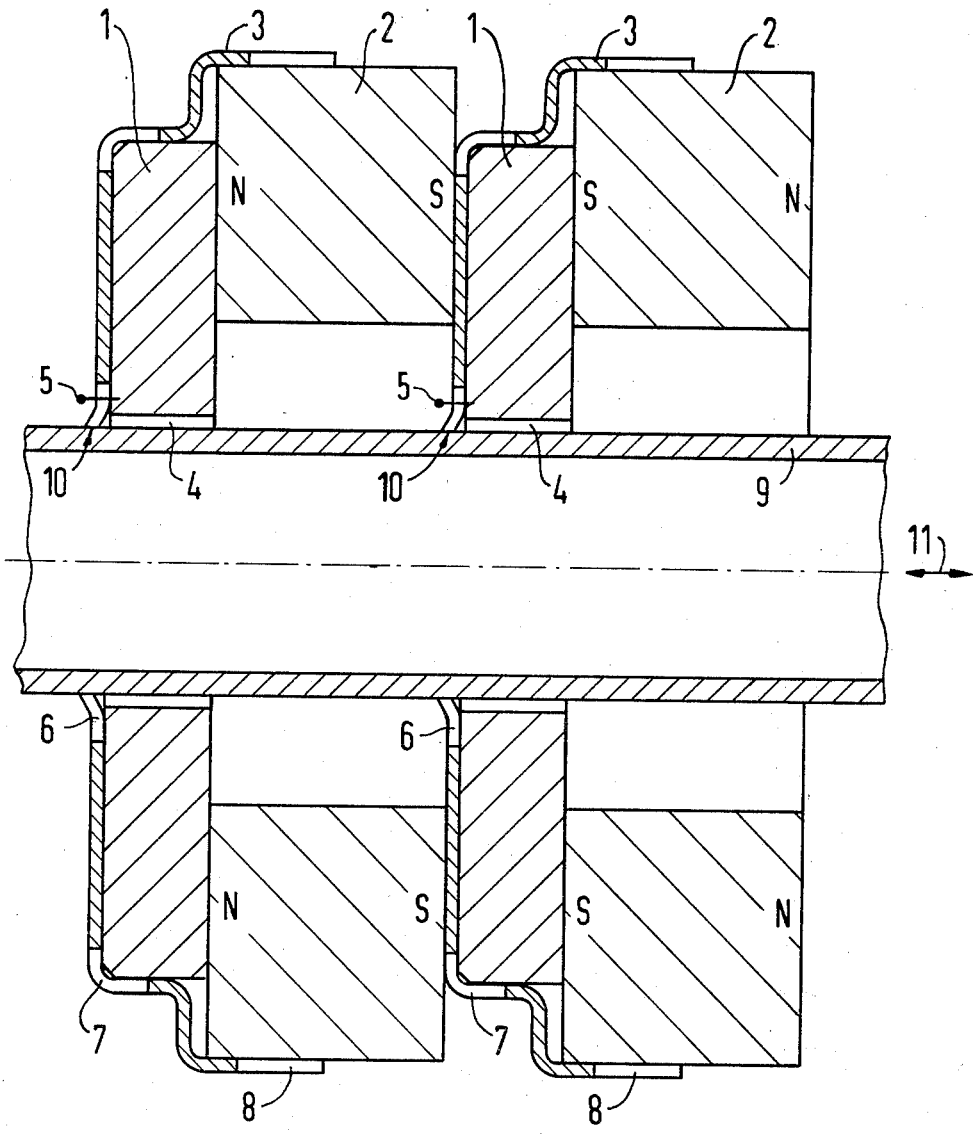
1
3
2
1
3
2
N
S
S
N
5
5
10
4
10
4
9
11
6
6
N
S
S
N
7
7
8
8

TRAVELLING WAVE TUBE WITH PERIODIC-PERMANENT MAGNET FOCUSING SYSTEM

The invention relates to a travelling wave tube with a cylindrical vacuum shell which is surrounded by a permanent magnet system including ring-shaped pole shoes, and disposed between them, alternatingly arranged in the axial direction are magnet rings or annular magnets which are poled in an opposite sense, whereby the pole shoes have a smaller inner diameter than the magnet rings, and are closely fitted around the vacuum shell with their inner openings.

A permanent magnet system of this type is known from German Patents DE-PS 21 19 817 and DE-PS 25 56 464. This system is also called a PPM-system (Periodic-Permanent-Magnetic Focusing System).

In the previously known PPM-systems, pole discs were used which were centralized on the vacuum tube of the travelling wave tube with a certain amount of play. At the same time, it was mandatory to maintain extremely accurate parallelism of the ring-magnets as well as of the pole discs. This system always caused difficulties with respect to adjustment (which took the form of long manufacturing time), and difficulties with respect to the mechanical and thermal stability during the operation of the tube.

The problem exists with periodic permanent magnetic (PPM)-focusing systems for travelling wave tubes, of producing a series of alternating magnetic fields, which can be easily adjusted on the tube. Additionally, a very stable behavior of the whole mechanical structure must be assured, even for relatively high thermal load, as well as for continuous loads and for changing loads.

It is accordingly an object of the invention to provide a travelling wave tube with periodic-permanent magnet focusing system, which overcomes the hereinaforementioned shortcomings of the heretofore-known devices of this general type, and to make the assembly and the adjustment of the magnetic stack technically simple and economical, and especially to mount the magnetic field stack of a periodic field in such a manner, that it can be easily adjusted on the tube, and also remain stable, mechanically as well as thermally.

With the foregoing and other objects in view there is provided, in accordance with the invention, a travelling wave tube, comprising a cylindrical vacuum shell having an outer diameter, a permanent magnet system surrounding the cylindrical vacuum shell including ring-shaped pole shoes having inner and outer diameters, magnet rings having inner and outer diameters and forming pairs with the pole shoes, each of the magnet rings being alternatingly disposed between two pole shoes in axial direction and being poled in opposite sense (polarized) with respect to the next magnet ring, the inner diameters of the pole shoes being closely fitted around the vacuum shell and being smaller than the inner diameters of the magnet rings, the outer diameters of the magnet rings being larger than the outer diameters of the pole shoes, and a centering and retaining ring being adjacent to and in close contact with each of the pole shoe and magnet ring pairs for centralizing the inner diameters of the pole shoes to the outer diameters of the magnet rings and for centralizing the inner diameters of the pole shoes and the outer diameters of the magnet rings to the outer diameter of the vacuum shell.

In accordance with another feature of the invention, the centering and retaining ring has multiple slits formed in the periphery thereof.

The accordance with a further feature of the invention, the centering and retaining ring has an inner diameter and multiple slits formed therein at the inner diameter.

In accordance with an added feature of the invention, the centering and retaining ring is formed of non-magnetic material.

In accordance with an additional feature of the invention, the centering and retaining ring is formed of copper, beryllium and bronze.

In accordance with a concomitant feature of the invention, the centering and retaining ring is formed of soft magnetic iron.

The invention has the advantage that because of the arrangement wherein the magnet rings have a greater outer diameter than the ring-shaped pole shoes, an optimal ratio between magnetically effective flux (on the axis of the tube) to the stray flux (in the outer area of the magnet stack) is obtained.

Because of the centering-and retaining ring, the inner diameter of the pole shoes is centered with respect to the outer diameter of the magnet rings, and these two diameters are centered to the outer diameter of the vacuum shell of the travelling wave tube. In order to accuractely fit these diameters, the centering and retaining ring is preferably slit in several places at its periphery, so that small dimensional deviations or tolerances can be equalized by small elastic deformations or short spring paths. For the same reason, the centering and retaining ring can also have several slits at its inner diameter. By virtue of a relatively stiff spring action, it can be assured that, on one hand, the tolerances are equalized, and on the other hand, the centering effect is maintained and the system is not stressed by thermal loads.

It is useful to make the centering-and retaining ring of a non-magnetic material, preferably of copper beryllium bronze. A further advantage is obtained thereby. A defined non-magnetic gap is created at one side between magnet ring and pole shoe, while at the other side, the magnetic contact between the two is assured. This is advantageous, because in this manner defined and clean magnetic conditions are obtained, which otherwise can only be achieved by maintaining extreme parallelism of all rings (magnet-rings and pole shoes).

However, in cases in which the magnetic field is to be completely utilized, and an additional gap would be counter-productive, the centering and retaining ring can also be advantageously made of magnetic soft iron. Therefore, nothing of the favorable ratio of the two outer diameters of annular pole shoe and magnet ring is lost.

It is advantageous to produce the centering and retaining ring first as a disc or stamped part with blanked slits, and in a second work operation, to obtain the final shape by deep-drawing. The simple, ring-shaped pole shoe can be made as a stamped part.

Other features which are considered as characteristic for the invention are set forth in the appended claims.

Although the invention is illustrated and described herein as embodied in a travelling wave tube with periodic-permanent focusing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a fragmentary, diagrammatic cross-sectional view of an embodiment of the invention, in which parts of the tube which are not absolutely necessary for the understanding of the invention have been omitted.

Referring now particularly to the single FIGURE of the drawing, there is seen a partial section of the vacuum-shell of a travelling wave tube with a periodic-permanent-magnet focussing system which is disposed around it. The cylindrical vacuum shell 9 is accordingly surrounded by a permanent magnet system including ring-shaped pole shoes 1 and magnet rings 2 which are poled in a mutually opposite sense between the pole shoes alternatingly arranged in the axial direction. The pole shoes 1 have a smaller diameter than the magnet rings 2, and are closely fitted around the vacuum shell 9 with their inner openings. For example, a V2A-tube may be used as the vacuum tube. The magnet-rings 2 have a greater outer diameter than the ring-shaped pole shoes 1. A centering and retaining ring 3 is disposed closely adjacent to each pole shoe-magnet-ring pair, to centralize the inner diameter of the pole shoes 1 to the outer diameter of the magnet rings 2, and both diameters to the cylindrical vacuum shell 9. The centering and retaining ring 3 is therefore provided with steps, and lies at least partially at the outer circumference and side surface of the pole shoe 1, and also at the outer surface of the magnet ring 2. The centering and retaining ring 3 is provided at its circumference or periphery with multiple slits 6, 7, 8, so that small allowable variations can be equalized by small elastic deformations. The several slits 6 formed at the inner diameter of the centering and retaining ring 3 make it especially certain, through the use of a relatively stiff spring action, that a defined air gap 4 is formed between the pole shoes 1 and the vacuum shell, that tolerances can be equalized, that in spite of this the centralizing function is maintained, and that the system cannot be stressed by thermal loads. The contact point of the centering and retaining ring 3 to the vacuum shell 9, where the centering and equalization takes place, has been designated with reference numeral 10. The direction of the magnetic field $B_Z$ on the tube axis has been indicated by the double arrow 11. It can additionally be useful to weld the centering and retaining ring 3 to the pole shoe. To accomplish this, a welding seam or a spot weld 5 is preferably provided in the region of the multiple slits 6 at the inner diameter of the centering and retaining ring 3, between the ring and the pole shoe 1.

There is claimed:

1. Travelling wave tube, comprising a cylindrical vacuum shell having an outer diameter, a permanent magnet system surrounding said cylindrical vacuum shell including ring-shaped pole shoes having inner and outer diameters, magnet rings having inner and outer diameters and forming pairs with said pole shoes, each of said magnet rings being alternatingly disposed between two pole shoes in axial direction and being poled in opposite sense with respect to the next magnet ring, said inner diameters of said pole shoes being closely fitted around said vacuum shell and being smaller than said inner diameters of said magnet rings, said outer diameters of said magnet rings being larger than said outer diameters of said pole shoes, and a respective centering and retaining ring being disposed between and in contact with each of said pole shoe and magnet ring pairs for centralizing said inner diameters of said pole shoes to said outer diameters of said magnet rings and for centralizing said inner diameters of said pole shoes and said outer diameters of said magnet rings to said outer diameter of said vacuum shell.

2. Travelling wave tube according to claim 1, wherein said centering and retaining ring has multiple slits formed in the periphery thereof.

3. Travelling wave tube according to claim 1 or 2, wherein said centering and retaining ring has an inner diameter and multiple slits formed therein at said inner diameter.

4. Travelling wave tube according to claim 1, wherein said centering and retaining ring is formed of non-magnetic material.

5. Travelling wave tube according to claim 4, wherein said centering and retaining ring is formed of copper, beryllium and bronze.

6. Travelling wave tube according to claim 1, wherein said centering and retaining ring is formed of soft magnetic iron.

* * * * *